US007476795B2

(12) United States Patent
Toyama

(10) Patent No.: US 7,476,795 B2
(45) Date of Patent: Jan. 13, 2009

(54) KEYBOARD DEVICE FOR ELECTRONIC MUSICAL KEYBOARD INSTRUMENT

(75) Inventor: Yutaka Toyama, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 30 days.

(21) Appl. No.: 11/820,449

(22) Filed: Jun. 18, 2007

(65) Prior Publication Data

US 2008/0121091 A1 May 29, 2008

(30) Foreign Application Priority Data

Jun. 21, 2006 (JP) ..... 2006-171217

(51) Int. Cl.
*G10C 3/12* (2006.01)

(52) U.S. Cl. ..... 84/433; 84/434; 84/435; 84/436; 84/423 R

(58) Field of Classification Search ..... 84/423 R, 84/433–436
See application file for complete search history.

(56) References Cited

U.S. PATENT DOCUMENTS 2,474,462 A * 6/1949 Brewer ..... 84/404
3,263,550 A * 8/1966 Proll ..... 84/423 R
3,543,631 A * 12/1970 Ohno ..... 84/433
3,570,359 A * 3/1971 Ohno ..... 84/423 R
3,855,894 A * 12/1974 Thomas et al. ..... 84/423 R
3,903,780 A * 9/1975 Aliprandi ..... 84/433
4,128,035 A * 12/1978 Erickson et al. ..... 84/433
4,418,605 A * 12/1983 Tollefsen et al. ..... 84/434
4,488,472 A * 12/1984 Kumano et al. ..... 84/434
4,914,999 A * 4/1990 Masubuchi et al. ..... 84/423 R
5,131,308 A * 7/1992 Katsuta ..... 84/434
5,574,241 A * 11/1996 Kumano et al. ..... 84/439
5,824,928 A * 10/1998 Kumano et al. ..... 84/423 R
6,087,576 A * 7/2000 Masubuchi ..... 84/433
7,060,883 B2 * 6/2006 Nagaoka et al. ..... 84/423 R
7,176,370 B2 * 2/2007 Osuga et al. ..... 84/433
7,326,844 B2 * 2/2008 Nishida ..... 84/423 R (Continued)

FOREIGN PATENT DOCUMENTS

JP 6-31507 8/1994

(Continued)

*Primary Examiner*—Walter Benson
*Assistant Examiner*—Robert W Horn
(74) *Attorney, Agent, or Firm*—Morrison & Foerster LLP

(57) ABSTRACT

A keyboard device is designed for use in an electronic musical keyboard instrument, and composed of a key frame and at least one key array unit mounted in the key frame. The key array unit has a plurality of keys and a common base part which integrates the plurality of the keys and which is fixed to the key frame. The key is composed of a key body having a front end portion, a rear end portion and a top face portion extending between the front end portion and the rear end portion, and a key supporting part which supports the key body in a vicinity of the rear end portion thereof for allowing the key body to pivot around the key supporting part when the top face portion of the key body is pressed downward and which couples the key body integrally to the common base part. The key supporting part is formed below a back of the top face portion of the key body at a position spaced from the rear end portion of the key body toward the front end portion of the key body.

8 Claims, 4 Drawing Sheets

U.S. PATENT DOCUMENTS

| | | | | |
|---|---|---|---|---|
| 2007/0295192 | A1* | 12/2007 | Watanabe | 84/423 R |
| 2007/0295193 | A1* | 12/2007 | Toyama | 84/423 R |
| 2008/0066608 | A1* | 3/2008 | Osuga | 84/423 R |
| 2008/0121091 | A1* | 5/2008 | Toyama | 84/436 |
| 2008/0210079 | A1* | 9/2008 | Osuga et al. | 84/423 R |

FOREIGN PATENT DOCUMENTS

| | | |
|---|---|---|
| JP | 2628656 | 4/1997 |
| JP | 2001-265348 | 9/2001 |

* cited by examiner

KEYBOARD DEVICE FOR ELECTRONIC MUSICAL KEYBOARD INSTRUMENT

BACKGROUND OF THE INVENTION

1. Technical Field of the Invention

The present invention relates to an electronic musical keyboard instrument, and more particularly, to a keyboard device for an electronic musical keyboard instrument that is capable of being manufactured compactly with an improved arrangement of a key supporting part.

2. Description of the Related Art

A typically known electronic musical keyboard instrument, such as a portable keyboard, a synthesizer, an electronic organ, an electronic piano, etc., has a keyboard structure which is configured such that plural keys constitute a key array unit and plural key array units are united and fixed to a key frame. For example, reference is made to FIGS. 2 and 3 of Patent Reference 1 (Japanese Patent Registration No. 2628566).

For example, keys of one octave are separated into one structure which includes plural black keys (a black key array unit) and plural structures in which white keys are arranged in a comb teeth shape while being separated from each other by an interval of at least one key (for example, a white key array unit including four keys of C, E, G and B, and a white key array unit including three keys of D, F and A). Rear end portions of the respective keys are coupled to a common base part and integrally formed by resin, and the plural key array units are united at the common base part and fixed to a key frame.

FIG. 7 is a view illustrating a key to explain the drawback of a conventional key array unit.

In the drawing, a reference numeral 81 refers to a key body, 81*a* refers to a horizontal hinge section which allows the key body 81 to pivot in a stroking direction of the key by elastic deformation of a rear end portion of the horizontal hinge section, 81*b* refers to an orthogonal hinge section which is orthogonal to the horizontal hinge section 81*a* and which allows the key body 81 to move in a transverse direction of the key, and 82 refers to a band-shaped common base part.

The horizontal hinge section 81*a* is configured as a horizontal thin plate piece which has a thin thickness along a downward direction of the key (a vertical direction of the key) and is disposed along a longitudinal direction of the key (a direction from a front end of the key to a rear end of the key). The orthogonal hinge section 81*b* is configured as an orthogonal thin plate piece which has a thin thickness in the transverse direction of the key (a widthwise direction of the key) and is disposed along the longitudinal direction of the key.

The horizontal hinge section 81*a* is connected to the orthogonal hinge section 81*b* by a coupling part 81*c* therebetween, and the orthogonal hinge section 81*b* is connected to the common base part 82 by a coupling part 81*d* therebetween. Each of the coupling parts 81*c* and 81*d* is formed in a plate piece shape which has a predetermined thickness along the longitudinal direction of the key and is disposed along the width direction of the key.

A reference numeral 81*e* refers to a stopper piece, which contacts a stopper provided at the key frame to restrict a pivot range of the key body 81. In Patent Reference 1 (see FIG. 1), the stopper piece 81*e* is inserted into a slit formed at the frame, to also function as a key guide.

Although the key body 81 is deformed in the width direction of the key due to after-shrinkage or the like during fabrication of the key array unit, the orthogonal hinge section 81*b* is bent slightly so that the key body 81 moves in the width direction of the key to adjust its position, and an inclination in the width direction of each key is adjusted so that the key body 81 is at right angle to the common base part 82.

However, because the key body 81 is connected to the common base part 82, which is disposed along the longitudinal direction, at the rear end portion while interposing a key supporting part having the horizontal hinge section 81*a*, which is disposed along the longitudinal direction, between the key body 81 and the common base part 82, a length between a front end and a rear end of the keyboard device is lengthened. Accordingly, a length between a front end and a rear end of an electronic musical keyboard instrument accommodating the keyboard device is also lengthened. Further, the upper portion of the common base part 82 is covered with a panel of a main body of an instrument, and a space for mounting switches and the like below the panel is required. Accordingly, there is a drawback that the panel of the main body of the instrument should be located sufficiently high over the common base part 82.

In order to shorten the length between the front end and the rear end of the keyboard device, the orthogonal hinge section 81*b* is possibly removed, but the horizontal hinge section 81*a* and the common base part 82 should not be removed.

Meanwhile, a keyboard device which uses a vertical hinge as the key supporting part is known. For example, reference is mad to Patent Reference 2 (Japanese Utility Model Laid-Open Publication No. H6-31507).

A vertical hinge section is formed at a middle portion in the longitudinal direction of each key constituting the key array unit (a position where the rear face portion of the black key is located). The vertical hinge section is configured as a thin plate piece which has a thin thickness in the longitudinal direction of the key, is disposed along the width direction of the key, and extends downward in the vertical direction of the key. The vertical hinge section allows the front end portion of the key to pivot in the stroking direction of the key. The vertical hinge section is integrally formed with the band-shaped common base part which is positioned on the same plane as the vertical hinge section. In this Patent Reference, a balance weight is provided at the rear portion of the key, or the rear end portion of the key is in contact with a lever to which the balance weight is attached, and thus the key body is configured to extend rearward from the position where the rear face portion of the black key is located.

If not extending the rear end portion of each key rearward but extending downward and making the extended portion function as the vertical hinge section, the keyboard device can be shortened in the longitudinal direction of the key when compared to the horizontal hinge section.

At this time, if extending the vertical hinge section downward sufficiently long, because the hinge is displaced while twisting by force exerted in the width direction of the key, the movable range becomes broad.

As described above, if using the aforesaid vertical hinge section as the key supporting part, extending the rear end portion of each key in a perpendicular direction, forming the extended portion to have a thin thickness to function as an elastic deformation part, and connecting the lower end of the elastic deformation part of each key to the band-shaped common base part, the length between the front end and the rear end can be shortened in comparison to the horizontal hinge section.

However, the rear portion of the key body is blocked by the vertical hinge section. As a result, an empty space is formed below the rear portion of the key body. On occasion, other components of the electronic musical keyboard instrument are mounted in the empty space.

For example, there is another known keyboard device that is capable of guiding a player to press down the proper keys during the musical performance. This conventional keyboard device is constituted such that a light emitting diode for guiding the musical performance is mounted under the front portion of each key body, i.e., the key pressing position, and a light guide member is mounted to the back face of the key to guide the light to the rear portion of the key. For example, reference is made to Patent Reference 3 (Japanese Patent Laid-open Publication No. 2001-265348).

However, because the front lower portion of the key body is hidden by the player's finger and palm during the musical performance, the player cannot occasionally see the musical performance guide member. Therefore, it is effective to guide the light to be irradiated to the rear portion of each key, but the light guide member causes increase in costs.

There is another type of keyboard product which is constituted such that a light emitting diode is mounted to a position corresponding to each key on a front end of a panel covering the rearward of the key board in order to guide the musical performance. However, because the key itself does not glow, the player has difficulty in distinguishing the keys to be pressed down. Further, because the panel is opaque, there are drawbacks of necessarily forming holes to guide light at the panel and attaching a light-permeable sheet to the surface of the panel.

To cope with the above problems, it can be considered to dispose the light emitting part below the rear portion of each key body. However, it is impossible to use the aforesaid empty space because of the presence of the aforesaid vertical hinge section.

SUMMARY OF THE INVENTION

Therefore, the present invention has been made in view of the above problems, and it is an object of the present invention to provide a keyboard device for an electronic musical keyboard instrument that is capable of being manufactured compactly and increasing a degree of freedom of designing arrangement and the like of light emitting parts for guiding the musical performance.

In accordance with the present invention, the above and other objects can be accomplished by the provision of a keyboard device for an electronic musical keyboard instrument, comprising a key frame and at least one key array unit mounted in the key frame. The key array unit comprises a plurality of keys and a common base part which integrates or unites the plurality of the keys and which is fixed to the key frame. The key comprises a key body having a front end portion, a rear end portion and a top face portion extending longitudinally between the front end portion and the rear end portion, and a key supporting part which supports the key body in a vicinity of the rear end portion thereof for allowing the key body to pivot around the key supporting part when the top face portion of the key body is pressed downward and which couples the key body integrally to the common base part. The key supporting part is formed below a back of the top face portion of the key body at a position spaced from the rear end portion of the key body toward the front end portion of the key body.

Accordingly, when compared to a conventional keyboard device in which the key supporting part protrudes rearward from the key body, a length between the front end and the rear end of the keyboard device is shortened, and an empty space can be formed behind the key supporting part.

In addition, another empty space can be formed at a position directed toward the rear end portion, where the key supporting part is not formed, between the back of the rear top face portion of the key body and the key frame.

Because members constituting the keyboard device and components constituting the electronic musical keyboard instrument are accommodated in the empty spaces, the keyboard device can be manufactured compactly.

Because there is a little member which is needed to be mounted in the space between the back of the rear top face portion of the key body and the key frame, when disposing new components constituting the electronic musical keyboard instrument in this space, a degree of freedom of design is increased.

So long as it has a function of allowing the key to pivot in the stroking direction of the key, the structure of the key supporting part can be configured as any one of a horizontal hinge section, a vertical hinge section, and a combination thereof. It is most preferred that the horizontal hinge section is applied to the white key and the vertical hinge section is applied to the black key.

Preferably in the inventive keyboard device for an electronic musical keyboard instrument described above, the key body has the rear end portion which is made open to define an open space or empty space in the key body.

Accordingly, components constituting the electronic musical keyboard instrument can be mounted in the empty space extending to the rear end portion of the key body, between the below of the back of the rear top face portion of the key body and the key frame.

Preferably, the keyboard device for an electronic musical keyboard instrument described above further comprises a plurality of light emitting parts which are provided in correspondence to the plurality of the keys to illuminate the same, wherein the light emitting part is disposed inside the rear end portion under the back of the top face portion of the key body which is made of light permeable material.

Accordingly, since the light emitting part is disposed at the back side of the rear top face portion of each key body, the rear top face portion of each key body can glow by irradiating the light thereto from the below.

Also, because the back side of the rear top face portion of the key body is contiguous to the below of the manipulation panel, it is possible to load the light emitting part on a substrate for mounting components of the manipulation panel.

The light emitting part can be used for guiding the musical performance of the electronic musical keyboard instrument. When mounting the light emitting part for guiding the musical performance, a conventional keyboard device is structured such that the light emitting part is mounted below the front end portion of each key, i.e., the key pressing position. But, a plurality of structural members are aggregated below the key pressing position. Particularly, in the case of a keyboard of a piano having weights, a key guide and a member having a contact portion with the weight are provided below the key pressing position. Accordingly, arranging the light emitting part at the back side of the rear top face portion of each key body increases a degree of freedom of design.

In one form of the keyboard device according to the invention, the key supporting part comprises a connecting section extending downward vertically from the back of the top face portion of the key body, and a vertical hinge section which is formed vertically between the connecting section and the common base part and which is bent to allow the key body to pivot around the vertical hinge section.

In another form of the keyboard device according to the invention, the key supporting part comprises a connecting section extending downward vertically from the back of the top face portion of the key body, and a horizontal hinge section which is formed horizontally between the connecting section and the common base part, and which is bent to allow the key body to pivot around the horizontal hinge section.

In still another form of the keyboard device according to the invention, the key supporting part comprises a vertical hinge section which extends downward vertically from the back of the top face portion of the key body and which is bent to allow the key body to pivot around the vertical hinge section, and an orthogonal hinge section which is formed orthogonally between the vertical hinge section and the common base part and which is bent to allow the key body to pivot around the orthogonal hinge section in a transverse direction of the key body.

In accordance with the present invention structured as above, the length between the front end and the rear end of the keyboard device is shortened, and the empty space can be secured at the rearward of the key supporting part. In addition, another empty space can be secured below the back of the rear top face portion of the key body, in which other members constituting the keyboard device and components constituting the electronic musical keyboard instrument can be disposed. Accordingly, the keyboard device and the electronic musical keyboard instrument having the same are manufactured compactly.

Also, when newly mounting components in the empty space, a degree of freedom of design is increased.

DETAILED DESCRIPTION OF THE INVENTION

Figure 1:
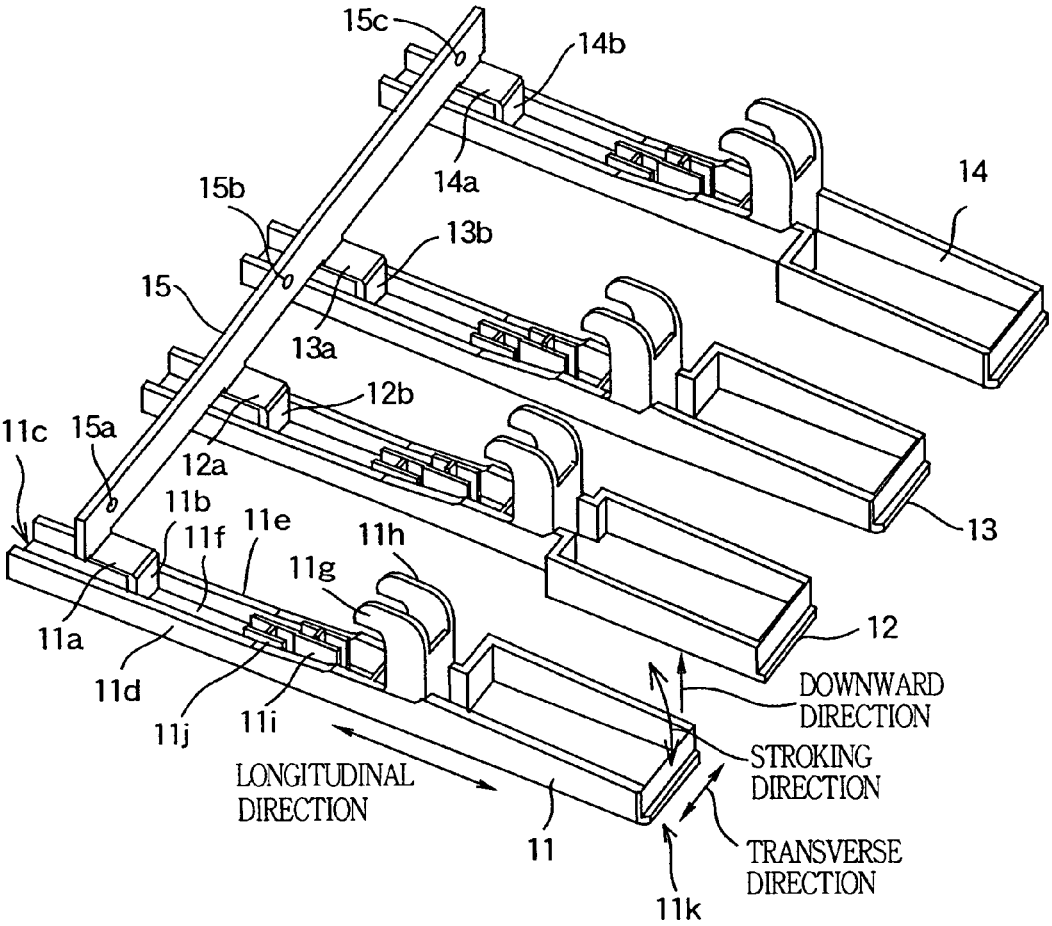
FIGS. 1(*a*) and 1(*b*) are perspective views illustrating an exemplary embodiment of the present invention.
Figure 1:
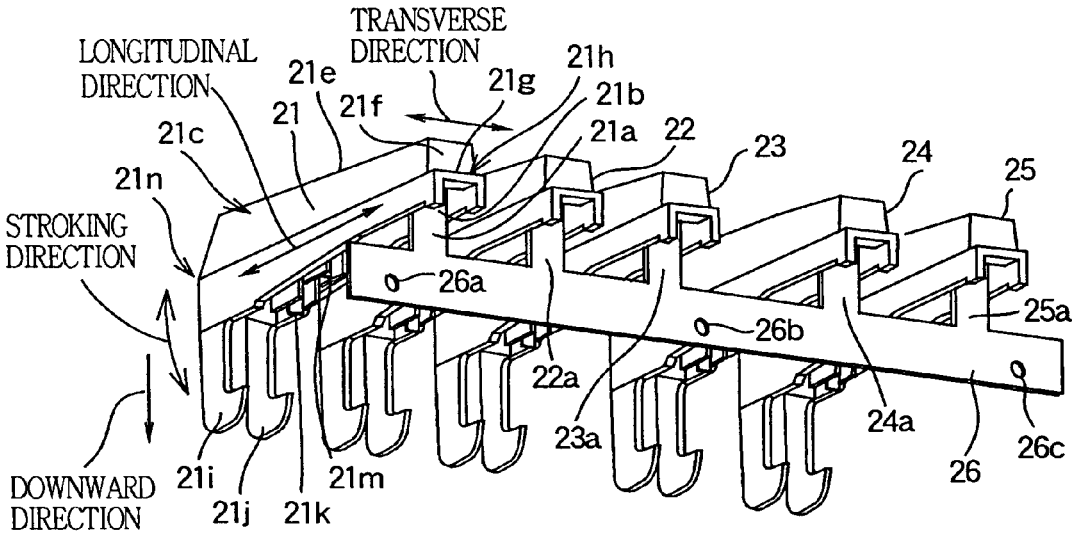

FIG. 1 is a perspective view illustrating an exemplary embodiment of the present invention. FIG. 1(*a*) is a perspective view of a white key array unit 1 when seen from below, and FIG. 1(*b*) is a perspective view of a black key array unit when seen from rear. The key array unit of one octave is illustrated in the drawing.

In FIG. 1(*a*), reference numerals 11 to 14 refer to key bodies of a B key, a G key, an E key, and a C key, respectively, which constitute the white key array unit 1.

The key bodies 11 to 14 are formed with key supporting parts, which allow the keys to pivot in a stroking direction of the key, below backs of top faces of rear portions of the key bodies. In this embodiment, it is illustrated that the key supporting parts are configured as horizontal hinge sections 11*a* to 14*a*. The key supporting parts are coupled to a common base part 15, and the key supporting parts and the common base part 15 are integrally formed by resin. The common base part 15 is formed in a band shape, which has a thin thickness along a longitudinal direction of the key (a direction from a front end of the key to a rear end of the key) and is disposed along a width direction of the key (a transverse direction of the key).

The common base part 15, a common base part 28 of a white key array unit 2 which will be described with reference to FIG. 2(*b*), and a common base part 26 of a black key array unit 3 which will be described with reference to FIG. 1(*b*) are aligned and fixed together to a key frame (not shown) by tightening screws or the like through coupling holes 15*a* to 15*c*.

Since all the white keys have the same shape, only the B key will be explained hereinafter.

The horizontal hinge section 11*a* is formed in a thin plate piece shape, which has a thin thickness along a downward direction of the key (a vertical direction of the key) and is disposed along a longitudinal direction of the key. The horizontal hinge section 11*a* has a width (along the transverse direction of the key) equal to a distance between an inner surface of a right side portion 11*d* and an inner surface of a left side portion 11*e*. The horizontal hinge section 11*a* allows a front end portion (a free end portion) 11*k* of the key to pivot in the stroking direction of the key (by typical performance of pressing down the key).

Figure 2:
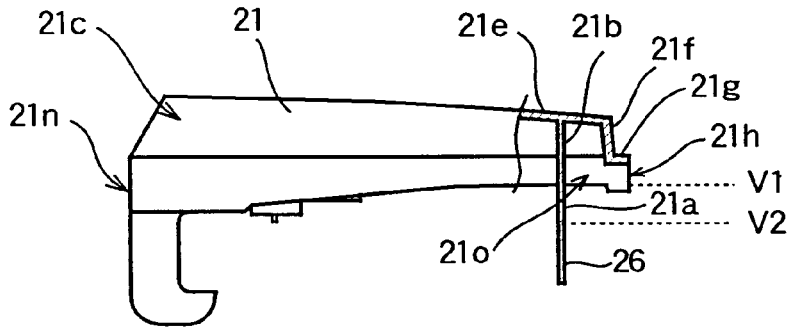
FIGS. 2(*a*) to 2(*d*) are explanation views illustrating a black key array unit, a white key array unit and a white key array unit in accordance with an exemplary embodiment of the present invention.
Figure 2:
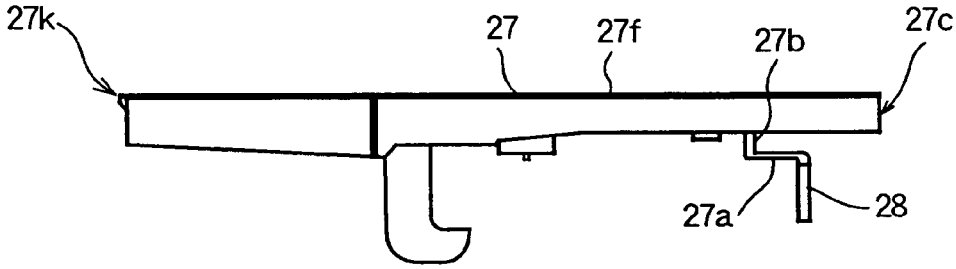
Figure 2:
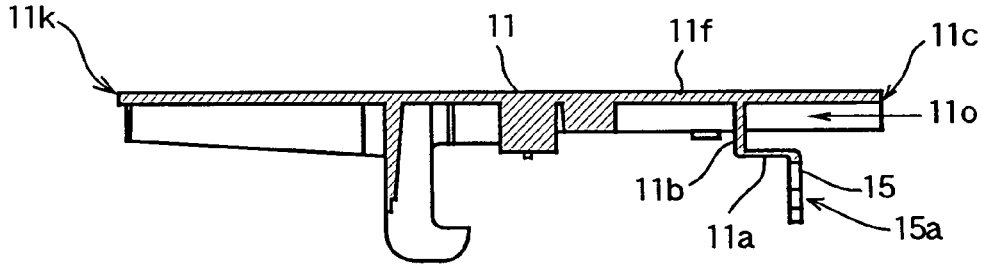
Figure 2:
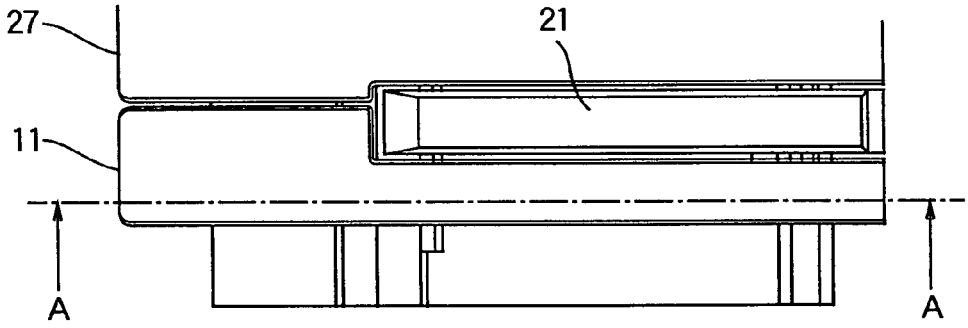

The thin plate piece of the horizontal hinge section 11*a* is in parallel with an top face portion 11*f* (see FIG. 2(*c*)), however, it may be inclined in the direction from the front end of the key to the rear end of the key.

Figure 7:
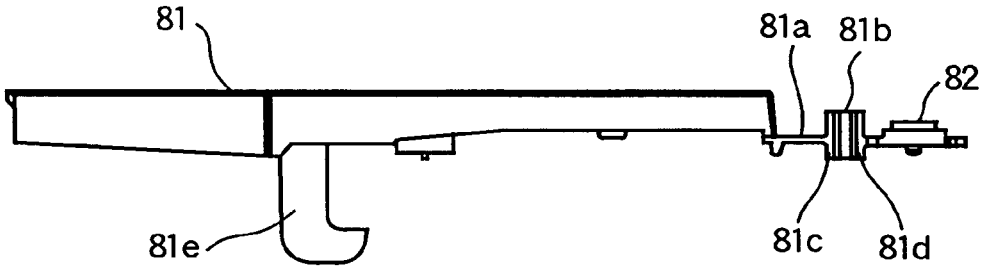
FIG. 7 is a view illustrating a key structure of a conventional key array unit.

The horizontal hinge section 11*a* is not coupled to the rear end portion 11*c*, different from the conventional key depicted in FIG. 7, but is disposed below the back of the top face portion 11*f*. A front end portion of the horizontal hinge section 11*a* is coupled to the key body 11 by a connecting section 11*b* at a position directed toward the front end portion 11*k* from the rear end portion 11*c*, and a rear end portion of the horizontal hinge section 11*a* is coupled to an upper end of the common base part 15.

The connecting section 11*b* is formed in a plate piece shape, which has a predetermined thickness along the longitudinal direction of the key and is disposed along the downward direction of the key. The connecting section 11*b* is coupled to the inner surface of the right side portion 11*d*, the inner surface of the left side portion 11*e*, and the back (a ceiling surface) of the top face portion 11*f*. The common base part 15 possibly has a thick thickness, and is located below the rear portion of the key body 11 and at a position directed toward the front end portion 11*k* from the rear end portion 11*c*.

As a result, an empty space is formed from the common base part 15 to the rear end portion 11*c*, below the rear portion of the key body 11. In addition, another empty space is formed from the connecting section 11*b* to the rear end portion 11*c*, at the back side of the top face portion 11*f*.

Reference numerals 11*g* and 11*h* refer to stopper pieces, which extend downward from the right side portion 11*d* and the left side portion 11*e* of the key body 11, and whose front ends are bent in an L-shape. Reference numerals 11*i* and 11*j* refer to first and second actuators, respectively, each of which protrudes in an H-shape from the back (the ceiling surface) of the top face portion 11*f* and is disposed along the direction from the front end of the key to the rear end of the key.

In FIG. 1(*b*), reference numerals 21 to 25 refer to key bodies of the respective keys which constitute the black key array unit.

The key bodies 21 to 25 are formed with key supporting parts, which allow the keys to pivot in the stroking direction of the key, below backs of top faces of rear portions of the key bodies. In this embodiment, it is illustrated that the key supporting parts are configured as vertical hinge sections 21*a* to 25*a*. The key supporting parts are coupled to the common base part 26, and the key supporting parts and the common base part 26 are integrally formed by resin.

The common base part 26 is formed in a band shape, which has a thin thickness along the longitudinal direction of the key and is disposed along the width direction of the key.

Since all the key bodies 21 to 25 have the same shape, only the key body 21 will be explained hereinafter.

The vertical hinge section 21*a* is formed in a thin plate piece shape, which has a thin thickness along the longitudinal direction of the key and is disposed along the downward direction of the key. The vertical hinge section 21*a* has a width equal to a distance between an inner surface of a right side portion 21*c* and an inner surface of a left side portion 21*d* (not shown). The vertical hinge section 21*a* allows a front end portion 21*n* of the key to pivot in the stroking direction of the key.

The vertical hinge section 21*a* extends downward perpendicularly to the key body 21, however, may be inclined in the direction from the front end of the key to the rear end of the key.

The vertical hinge section 21*a* is not coupled to a rear end portion 21*h* of the key body 21, but is disposed below the key body 21. The vertical hinge section 21*a* is coupled to a connecting section 21*b* formed at a position directed toward front end portion 21*n* from the rear end portion 21*h*, which will be described later with reference to FIG. 2(*a*). The vertical hinge section 21*a* has the same thickness and width as the connecting section 21*b*. A lower end of the vertical hinge section 21*a* is coupled to an upper end of the band-shaped common base part 26. In this embodiment, it is illustrated that the connecting section 21*b*, the vertical hinge section 21*a* and the common base part 26 are on the same plane.

The connecting section 21*b* is coupled to the back (the ceiling surface) of the top face portion 21*e*, the inner surface of the right side portion 21*c*, and the inner surface of the left side portion 21*d* (not shown). The common base part 26 possibly has a thick thickness, and is located below the rear portion of the key body 21 and at a position directed toward the front end portion 21*n* from the rear end portion 21*h*.

As a result, an empty space is formed from the common base part 26 to the rear end portion 21*h*, below the rear portion of the key body 21. In addition, an empty space is formed from the connecting section 21*b* to the rear end portion 21*h*, at the back side of the top face portion 21*e*.

Reference numerals 21*i* and 21*j* refer to stopper pieces, which extend downward from the right side portion 21*c* and the left side portion 21*d* (not shown) of the key body 21, and whose front ends are bent in an L-shape. Reference numerals 21*k* and 21*m* refer to first and second actuators, respectively, each of which protrudes in an H-shape from the back (the ceiling surface) of the top face portion 21*e* of the key body 21 and is disposed along the direction from the front end of the key to the rear end of the key.

FIG. 2 is an explanation view illustrating the black key array unit 3, the white key array unit 2 and the white key array unit 1 in accordance with an exemplary embodiment of the present invention.

FIG. 2(*a*) is a right side view of the black key array unit 3 explained with reference to FIG. 1(*b*), which partially illustrates a sectional structure.

FIG. 2(*b*) is a right side view of the white key array unit 2.

FIG. 2(*c*) is a right side sectional view of the white key array unit 1 explained with reference to FIG. 1.

FIG. 2(*d*) is a partial plan view of the keyboard device. FIG. 2(*c*) is a sectional view taken along line A-A in FIG. 2(*d*).

Referring to FIG. 2(*c*), the structure of the white key array unit 1 will be supplementarily explained.

The connecting section 11*b* is coupled to the back (the ceiling surface) of the top face portion 11*f*, however, may be disposed apart from the back. This is because if the connecting section 11*b* is coupled to the back surface, recesses are easy to be formed on the surface of the top face portion 11*f* during resin formation. By sliding a mold from the rear end portion 11*c*, a hole is formed between the back (the ceiling surface) of the top face portion 11*f* and the connecting section 11*b*.

The white key array unit 2 depicted in FIG. 2(*b*) consists of three keys of a D key, an F key, and an A key. The shapes and the dimensions of the horizontal hinge section 27*a* and the connecting section 27*b* may be the same as those of the horizontal hinge section 11*a* and the connecting section 11*b* of the white key array unit 1 depicted in FIG. 2(*c*).

In order to overlap the common base part 28 with the right side (on the drawing) of the common base part 15 depicted in FIG. 2(*c*), the common base part 28 is formed at a position where it is displaced toward the rear end portion 27*c* by the thickness of the common base part 15.

In the black key array unit 3 depicted in FIG. 2(*a*), a horizontal face portion 21*g* contacting the rear end portion 21*h* is shielded by a panel of a main body of an instrument, but a rear face portion 21*f* can be seen from outside. Thus, as also shown in FIG. 1(*b*), the rear face portion 21*f* is formed to be closed. On that account, it is difficult to form the connecting section and the horizontal hinge section below the rear portion of the black key body 21 due to restriction of the mold for resin formation.

From this point of view, the connecting section 21*b* is formed to be coupled to three members, i.e., the rear back (the ceiling surface) of the top face portion 21*e*, the right side portion 21*c*, and the left side portion 21*d* (not shown).

Similarly to the connecting section 11*b* explained with reference to FIG. 2(*c*), the connecting section 21*b* may be disposed apart from the back (the ceiling surface) of the top face portion 21*e*. By sliding the mold from the front end portion 21*n*, a hole is formed between the back (the ceiling surface) of the top face portion 21*e* and the connecting section 21*b*.

The vertical hinge section 21*a* is defined from a lower end position (V1 in the drawing) of the right side portion 21*c* and the left side portion 21*d* to a coupling position (v2 in the drawing) of the vertical hinge section 21*a* and the common base part 26. It is illustrated that the connecting section 21*b*, the vertical hinge section 21*a* and the common base part 26 have the same thickness and are formed on the same plane. However, the connecting section 21*b* and the common base part 26 may be formed to have the thickness thicker than the vertical hinge section 21*a*.

In order to overlap the common base part 26 with the right side (on the drawing) of the common base part 28 of the white key array unit 2 depicted in FIG. 2(*b*), the common base part 26 is formed at a position where it is displaced toward the rear end portion 21*h* by the thickness of the common base part 28.

Figure 3:
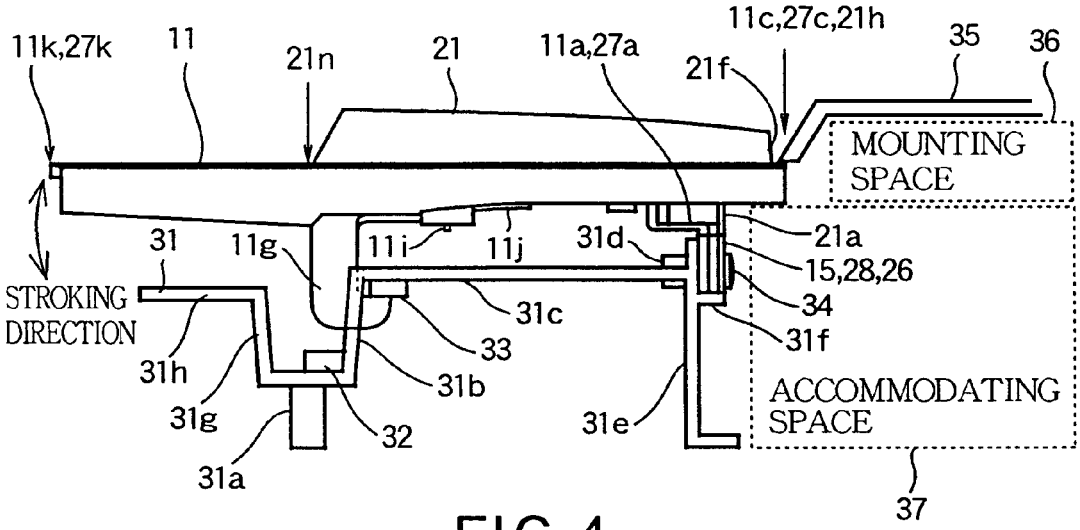
FIG. 3 is a right side view illustrating an assembled state of a keyboard device by uniting the key array units depicted in FIG. 2.

FIG. 3 is a right side view illustrating an assembled state of the keyboard device by uniting the key array units depicted in FIG. 2.

In the drawing, the same elements as shown in FIGS. 1 and 2 are denoted by the same reference numerals, and the explanation thereof will be omitted.

A reference numeral 31 refers to a key frame, which is made unitarily of resin, or made of a mixture of resin and other materials (e.g., metal). Reference numerals 31*a* and 31*d* refer to screw bosses to mount the key frame 31 to a lower housing of an electronic musical keyboard instrument.

A reference numeral 31*b* refers to a frame stepped portion. The frame stepped portion 31*b* is formed with a slit, through which each of lower front ends of the stopper pieces 11*g* and 11*h* is inserted. A lower stopper 32 and an upper stopper 33 are provided to restrict the moving range of each of the stopper pieces 11*g* and 11*h*.

A reference numeral 31*c* refers to a horizontal face portion, on which a substrate unit (not shown) is disposed. And, two key switches, e.g., dome-shaped on/off sensors having elasticity are loaded on the substrate unit. When pressing down the key body 11, the key switches are turned on with a time gap by the actuators 11*i* and 11*j*.

The common base parts 15, 28 and 26 depicted in FIG. 2 are overlapped in this order from the left side on the drawing so that the coupling holes of the common base parts are met. By tightening screws 34 through the coupling holes, the common base parts 15, 28 and 26 are fixed to a rear wall 31*e* of the frame. A reference numeral 31*d* refers to a screw boss for the screw 34, and 31*f* refers to a base seat portion on which lower ends of the common base parts 15, 28 and 26 are aligned.

A reference numeral 35 refers to a panel of the main body of the instrument, which covers the keyboard surface in the rear of the rear face portion 21*f* of the black key. Because the rear end portion of the white key is positioned at a little bit rear of the rear face portion 21*f* of the black key, it is covered with the panel 35 of the main body of the instrument. A keyboard surface, which is exposed from the panel 35 of the main body of the instrument, is called an external key surface.

It is illustrated that the lower front end of the stopper piece 11*g* (also the stopper piece 11*h*) of the key body 11 protrudes toward the rear of the key (toward the rear end portion 11*c*) such that the stopper piece 11*g* has an L-shape in the right side view.

Alternatively, each of the stopper pieces 11*g* and 11*h* may be formed such that the lower front end protrudes toward the front of the key (toward the front end portion 11*k*). In this case, the shape and the dimension of the key frame 31 are modified such that a front frame stepped portion 31*g* is formed with a slit and the lower front end of the stopper piece is inserted through the slit. The upper stopper 33 is disposed at a back of a front horizontal face portion 31*h* so that an upper portion of the lower front end of the stopper piece is in contact with the upper stopper 33 when not pressing the key. The lower stopper 32 is disposed at a position where the lower end of the stopper piece is in contact with the lower stopper 32 when pressing down the front end portion 11*k* of the key to the maximum.

The aforesaid modification of the stopper pieces 11*g* and 11*h*, the related change of the shape and the dimension of the key frame 31, and the change of arrangement of the upper stopper 33 and the lower stopper 32 can be identically applied to each key of the black key array unit 3 and the white key array unit 2 which are explained above with reference to FIGS. 1(*b*), 2(*a*) and 2(*b*). The above modification and changes can also be identically applied to each key in accordance with a second exemplary embodiment of the present invention which will be described later with reference to FIG. 6.

As shown in the drawings, the key supporting parts (the vertical hinge section 21*a* and the horizontal hinge sections 11*a* and 27*a*) and the common base parts 15, 28 and 26 are disposed below the backs of the rear top face portions of the key bodies 11, 27 and 21 and at positions directed toward the front end portions 11*k*, 27*k* and 21*n* from the rear end portions 11*c*, 27*c* and 21*h* (more strictly speaking, the rear end of the aforesaid external key surface). Further, if other key-related members (e.g., actuators and piano action mechanism) are removed from the rearward of the key supporting parts, an empty space can be secured below the panel 35 of the main body of the instrument.

Accordingly, the empty space below the panel 35 can be used as a mounting space 36 for mounting manipulating devices, switches and the like to the panel 35 of the main body of the instrument, and/or used as an accommodating space 37 for accommodating a main substrate, a battery case and the like therein.

If forming the mounting space 36 and the accommodating space 37 to have the same volume as a conventional product, the length between the front end and the rear end of the electronic musical keyboard instrument according to the present invention can be shortened.

The pivot points of the key bodies 11 and 27 are the horizontal hinge sections 11*a* and 27*a*, and the pivot point of the key body 21 is the vertical hinge section 21*a*. When seen in the longitudinal direction of the key, the pivot points are located at positions closer to the front end portions than a conventional product, and located below the key bodies 11, 27 and 21. Accordingly, when a player presses down the front end portions 11*k*, 27*k* and 21*n*, because the front end portions get close to the player, the player does not feel the sense of incongruity during the musical performance.

Figure 4:
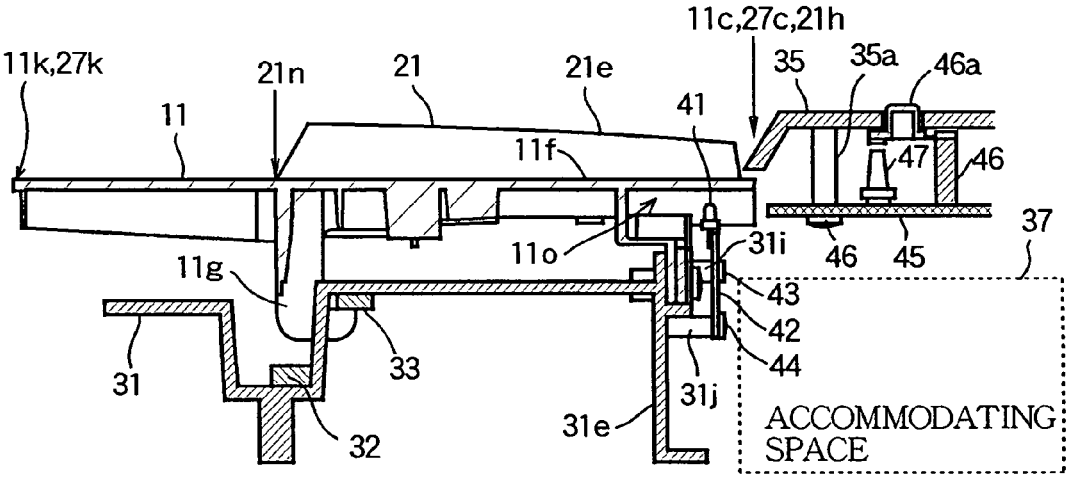
FIG. 4 is an explanation view illustrating a first embodiment in which light emitting parts for guiding the musical performance are mounted to the keyboard device depicted in FIG. 3.

FIG. 4 is an explanation view illustrating a first embodiment in which light emitting parts for guiding the musical performance are mounted to the keyboard device depicted in FIG. 3.

FIG. 4 also shows the sectional structure of the keyboard device depicted in FIG. 3 and a concrete example of the panel of the main body of the instrument.

In the drawing, the same elements as shown in FIG. 3 are denoted by the same reference numerals, and the explanation thereof will be omitted.

A reference numeral 41 refers to a light emitting part, for example, a light emitting diode (LED) for guiding the musical performance. The light emitting part 41 is mounted corresponding to each of the keys. According to the musical performance data which are derived by reproducing the prestored melody data, the light emitting part 41 selectively emits the light, and guides the player to press down the proper key.

Openings (empty spaces) 11*o*, 27*o* (not shown) and 21*o* (see FIG. 2(*a*)) are formed on the back sides of the rear top face portions 11*f*, 27*f* and 21*e* of the key bodies 11, 27 and 21 and at positions directed toward the front end portions from the rear end portions 11*c*, 27*c* and 21*h*. The light emitting part 41 is disposed in each of the openings 11*o*, 27*o* and 21*o*, and irradiates the light from the below of each of the rear top face portions 11*f*, 27*f* and 21*e*.

Each of the key bodies 11, 27 and 21 is made of a transparent or translucent material having light permeability, so that the lighting of the light emitting part 41 can be observed.

The plural light emitting parts, driving circuit elements and the like are mounted to a printed circuit board 42 for the light emitting part. The printed circuit board 42 is fixed to screw bosses 31*i* and 31*j* of the key frame 31 by tightening screws 43 and 44.

A reference numeral 45 refers to a panel substrate, to which elements for the panel 35 of the main body of the instrument are mounted. The panel substrate 45 is fixed to a screw boss 35*a* by tightening a screw 46. For example, a switch operating part 46 is mounted to the panel substrate 45, and a push button 46*a* of the switch operating part 46 is provided to protrude from the panel 35 of the main body of the instrument. When a user pushes the push button 46*a*, the switch mounted to the panel substrate 45 is pressed down.

The light emitting part 41 is not restricted to the LED, and can be configured as any light emitting means that is accommodated in each of the openings 11*o*, 27*o* (not shown) and 21*o* (see FIG. 2(*a*)) and is capable of functioning to irradiate the light toward the key and guide the musical performance.

Figure 5:
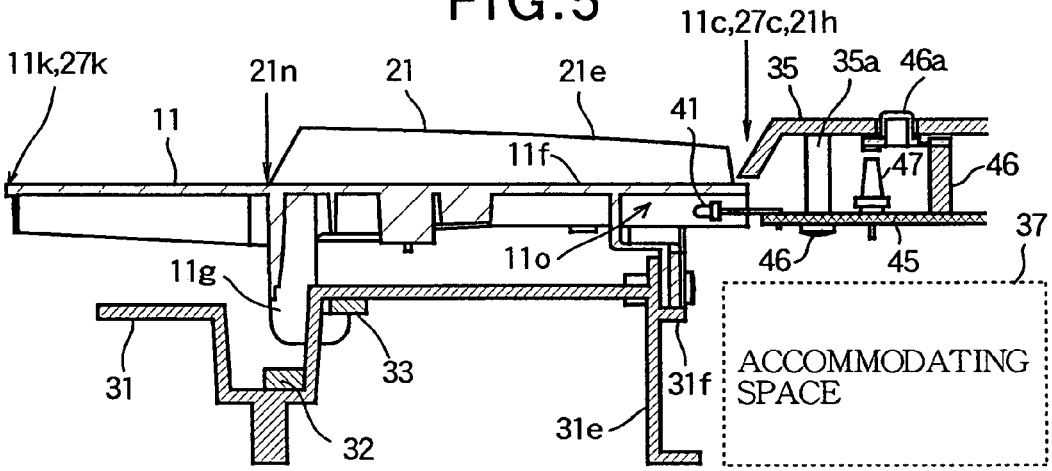
FIG. 5 is an explanation view illustrating a second embodiment in which light emitting parts for guiding the musical performance are mounted to the keyboard device depicted in FIG. 3.

FIG. 5 is an explanation view illustrating a second embodiment in which light emitting parts for guiding the musical performance are mounted to the keyboard device depicted in FIG. 3.

In the drawing, the same elements as shown in FIGS. 3 and 4 are denoted by the same reference numerals, and the explanation thereof will be omitted.

Because the rear end portions 11*c*, 27*c* and 21*h* are opened, a substrate (not shown) for the light emitting part can be disposed in the rear of the rear end portions 11*c*, 27*c* and 21*h*, and the light emitting part 41 can be disposed in each of the openings 11*o*, 27*o* (not shown) and 21*o* (see FIG. 2(*a*)) which are explained with reference to FIG. 4. As shown in the drawing, the panel substrate 45 can be configured to be combined with the substrate for the light emitting part. In this case, since the substrate for exclusive use in the light emitting part is not needed, the number of components can be reduced.

In the above description, it has been explained that the horizontal hinge sections are used as the key supporting parts for the white key array units 1 and 2 and the vertical hinge section is used as the key supporting part for the black key array unit.

But, the kind of the key supporting part using the hinge is not restricted to any one of the horizontal hinge section and the vertical hinge section. An arc-shaped hinge section can be used. Preferably, the key supporting part is disposed at a position directed toward the front end portion from the rear end portion of the key body. Since the key supporting part is positioned in the front of the rear end portion of the key, the distance from the key pressing point to the key supporting point is shortened. And, since the pivot point of the key is located at a lower position, the sense of incongruity during the musical performance can be decreased.

Figure 6:
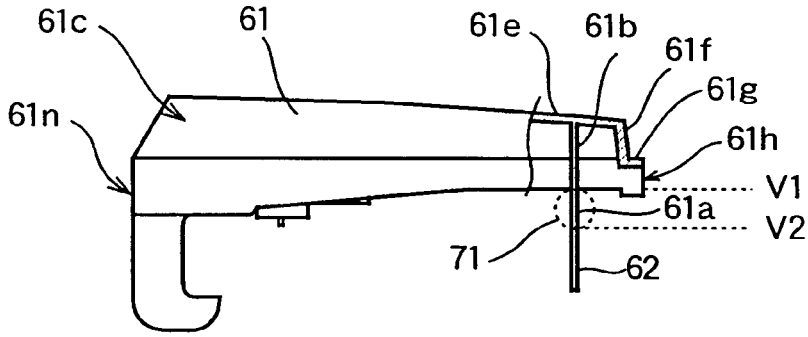
FIGS. 6(*a*) to 6(*c*) are explanation views illustrating key array units in accordance with another exemplary embodiment of the present invention.
Figure 6:
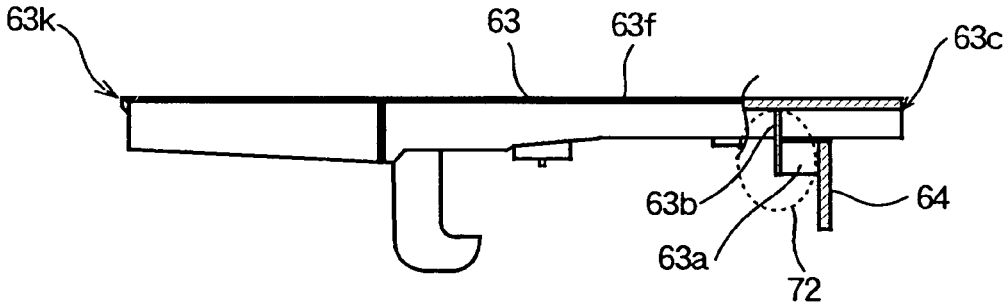
Figure 6:
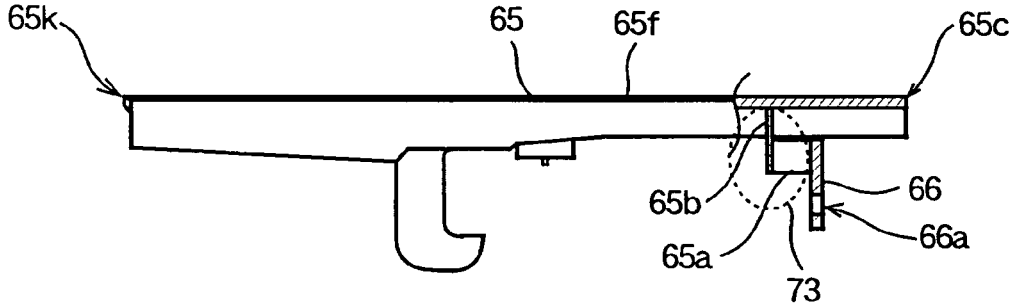

FIG. 6 is an explanation view illustrating key array units in accordance with another exemplary embodiment of the present invention.

FIG. 6(*a*) is a right side view of the black key array unit 3, FIG. 6(*b*) is a right side view of the white key array unit 2, and FIG. 6(*c*) is a right side view of the white key array unit 1. All FIGS. 6(*a*) to 6(*c*) show the sectional structure of the rear portion.

In this embodiment, a vertical hinge section and an orthogonal hinge section are used together as the key supporting part.

Referring to FIG. 6(*c*), the structure of the key supporting part of the white key array unit 1 will be described.

A reference numeral 65 is a key body which constitutes the white key array unit 1. A key supporting part 73 is formed below a back of a top face of a rear portion of the key body 65. The key supporting part 73 is coupled to a common base part 66, and the key supporting part 73 and the common base part 66 are integrally formed by resin. The common base part 66 is formed in a band shape, which has a thin thickness along the longitudinal direction of the key and is disposed along the width direction of the key.

The key supporting part 73 includes an orthogonal hinge section 65*a* and a vertical hinge section 65*b*.

The vertical hinge section 65*b* is formed in a thin plate piece shape, which has a thin thickness along the longitudinal direction of the key and is disposed along the downward direction of the key. The vertical hinge section 65*b* allows a front end portion 65*k* of the key to pivot in the stroking direction of the key. An upper end of the vertical hinge section 65*b* is coupled to a back (a ceiling surface) of an top face portion 65*f*, at a position directed toward the front end portion 65*k* from a rear end portion 65*c*. Slits are formed between the vertical hinge section 65*b* and the left and right side portions of the key, and the vertical hinge section 65*b* is disposed apart from the inner surfaces of the left and right side portions of the key.

The illustrated vertical hinge section 65*b* extends downward perpendicularly to the key body 65, however, may be inclined in the longitudinal direction of the key.

The orthogonal hinge section 65*a* is formed in a thin plate piece shape, which has a thin thickness along the width direction of the key and is disposed along the longitudinal direction of the key. Since the orthogonal hinge section 65*a* allows the front end portion 65*k* of the key to move in the width direction of the key, the movable range when force is applied in the width direction of the key becomes broad, stress concentrated on a root portion of the vertical hinge section 65*b* can be reduced, and durability of the vertical hinge section 65*b* is increased.

The front end of the orthogonal hinge section 65*a* is coupled to the middle of the lower rear surface of the vertical hinge section 65*b*, and the rear end of the orthogonal hinge section 65*a* is coupled perpendicularly to the front surface of the band-shaped common base part 66.

The common base part 66 possibly has a thick thickness, and is located below the rear portion of the key body 65 and at a position directed toward the front end portion 65*k* from the rear end portion 65*c*.

The upper portion of the vertical hinge section 65*b*, to which the orthogonal hinge section 65*a* is not coupled, functions as a pivot point of the key.

When only the vertical hinge is used, if extending the vertical hinge downward sufficiently long, because the hinge is displaced while twisting by force exerted in the width direction of the key, the movable range becomes broad. However, because the vertical hinge operates while slantedly twisting, the stress is concentrated on the root portion of the vertical hinge, and durability is deteriorated. Also, the key body easily rolls, and causes problem of generating mechanical noise due to contact with the adjacent key body and the key guide.

A key supporting part of a key body 63 of the white key array unit 2 depicted in FIG. 6(*b*) is the same as the key supporting part depicted in FIG. 6(*c*). The shapes and the dimensions of an orthogonal hinge section 63*a* and a vertical hinge section 63*b* can be the same as those of the orthogonal hinge section 65*a* and the vertical hinge section 65*b* of the white key array unit 1.

However, a common base part 64 is formed at a position where it is displaced toward the rear end portion 63*c* of the key by the thickness of the common base part 66.

The black key array unit 3 depicted in FIG. 6(*a*) has the same structure as the black key array unit 3 depicted in FIG. 2(*a*). However, the arrangement and the dimensions of components are determined such that a common base part 62 can be overlapped with the common base part 64 of the white key array unit 2 and the common base part 66 of the white key array unit 1 and aligned and fixed to the key frame 31.

It is preferable to also mount an orthogonal hinge section to the black key array unit 3. But, if doing so, it is difficult to perform a molding process. Thus, a key supporting part 71 consists of only a vertical hinge section 61*a*.

The orthogonal hinge sections 65*a* and 63*a* have the thickness thicker than the vertical hinge sections 65*b* and 63*b*. The common base parts 66 and 64 have the thickness thicker than the vertical hinge sections 65*b* and 63*b*, however, they may have the same thickness as the vertical hinge sections.

Similarly to the previous embodiment, the common base parts 66, 64 and 62 are overlapped so that coupling holes 66*a* of the common base parts are met. By tightening screws through the coupling holes, the common base parts 66, 64 and 62 are aligned and fixed to the key frame 31.

In this embodiment, the key supporting parts 73 to 71 and the common base parts 66, 64 and 62 are disposed below the backs of the rear top face portions of the key bodies 65, 63 and 61 and at positions directed toward the front end portions 65*k*, 63*k* and 61*n* from the rear end portions 65*c*, 63*c* and 61*h* (more strictly speaking, the rear end of the aforesaid external key surface). Accordingly, if other key-related members are removed from the rearward of the key supporting parts 71 to 73, an empty space can be secured below the panel 35 of the main body of the instrument.

Openings are formed between the top face portions 65*f*, 63*f* and 61*e* and the key supporting parts 73, 72 and 71. Moreover, since the rear end portions 65*c*, 63*c* and 61*h* are opened, light emitting parts for guiding the musical performance can be provided therein, similarly to FIGS. 4 and 5.

In the above description, the key body having two actuators has been explained. However, the key body may have one actuator. Further, the key body may have an after-touch sensor for detecting a depressed degree after pressing down the key, to perform after-touch control.

In the above description, it has been explained that the keys of one octave are divided into three key array units. However, the keys of one or more octaves can be divided, and the number of divided key array units can be varied.

The invention claimed is:

1. A keyboard device for use in an electronic musical keyboard instrument, comprising a key frame and at least one key array unit mounted in the key frame, wherein the key array unit comprises a plurality of keys integrally formed with a common base part which integrates the plurality of the keys and base part into a unit which is fixed to the key frame, wherein the key comprises a key body having a front end portion, a rear end portion and a top face portion with a uniform elevation extending between the front end portion and the rear end portion, and a key supporting part which supports and elastically holds the key body in a vicinity of the rear end portion thereof for allowing the key body to pivot elastically around the key supporting part when the top face portion of the key body is pressed downward and the key supporting part couples the key body integrally to the common base part to form the key array part, wherein the key supporting part is formed below a back of the top face portion of the key body at a position spaced from the rear end portion of the key body toward the front end portion of the key body.

2. The keyboard device according to claim 1, wherein the key body has the rear end portion which is made open to define an open space in the key body.

3. The keyboard device according to claim 1, further comprising a plurality of light emitting parts which are provided in correspondence to the plurality of the keys to illuminate the same, wherein the light emitting part is disposed inside the rear end portion under the back of the top face portion of the key body which is made of light permeable material.

4. The keyboard device according to claim 1, wherein the key supporting part comprises a connecting section extending downward vertically from the back of the top face portion of the key body, and a vertical hinge section which is formed vertically between the connecting section and the common base part and which is bent to allow the key body to pivot around the vertical hinge section.

5. The keyboard device according to claim 1, wherein the key supporting part comprises a connecting section extending downward vertically from the back of the top face portion of the key body, and a horizontal hinge section which is formed horizontally between the connecting section and the common base part, and which is bent to allow the key body to pivot around the horizontal hinge section.

6. The keyboard device according to claim 1, wherein the key supporting part comprises a vertical hinge section which extends downward vertically from the back of the top face portion of the key body and which is bent to allow the key body to pivot around the vertical hinge section, and an orthogonal hinge section which is formed orthogonally between the vertical hinge section and the common base part and which is bent to allow the key body to pivot around the orthogonal hinge section.

7. The keyboard device according to claim 1, comprising a black key array unit and a white key array unit, wherein the black key array unit comprises a plurality of black keys, each black key having the key supporting part which comprises a connecting section extending downward vertically from the back of the top face portion of the key body, and a vertical hinge section which is formed vertically between the connecting section and the common base part and which is bent to allow the key body to pivot around the vertical hinge section, and wherein the white key array unit comprises a plurality of white keys, each white key having the key supporting part which comprises a connecting section extending downward vertically from the back of the top face portion of the key body, and a horizontal hinge section which is formed horizontally between the connecting section and the common base part, and which is bent to allow the key body to pivot around the horizontal hinge section.

8. The keyboard device according to claim 1, comprising a black key array unit and a white key array unit, wherein the black key array unit comprises a plurality of black keys, each black key having the key supporting part which comprises a connecting section extending downward vertically from the back of the top face portion of the key body, and a vertical hinge section which is formed vertically between the connecting section and the common base part and which is bent to allow the key body to pivot around the vertical hinge section, and wherein the white key array unit comprises a plurality of white keys, each white key having the key supporting part which comprises a vertical hinge section extending downward vertically from the back of the top face portion of the key body and being bent to allow the key body to pivot around the vertical hinge section, and an orthogonal hinge section which is formed orthogonally between the vertical hinge section and the common base part and which is bent to allow the key body to pivot around the orthogonal hinge section.

* * * * *